US006926471B2

(12) United States Patent
Rambaud

(10) Patent No.: US 6,926,471 B2
(45) Date of Patent: Aug. 9, 2005

(54) PROTECTIVE BARRIER, IN PARTICULAR FOR MOUNTAINOUS PLACES

(75) Inventor: Pascal Rambaud, Allan (FR)

(73) Assignee: Mecanroc (FR)

( * ) Notice: Subject to any disclaimer, the term of this patent is extended or adjusted under 35 U.S.C. 154(b) by 0 days.

(21) Appl. No.: 10/434,838

(22) Filed: May 9, 2003

(65) Prior Publication Data

US 2004/0041139 A1 Mar. 4, 2004

Related U.S. Application Data

(63) Continuation-in-part of application No. PCT/FR01/03464, filed on Nov. 8, 2001.

(30) Foreign Application Priority Data

Nov. 9, 2000 (FR) ..... 00 14415

(51) Int. Cl.[7] ..... E01F 7/02; E02D 17/20
(52) U.S. Cl. ..... 405/302.7; 256/12.5
(58) Field of Search ..... 405/302.4, 302.7; 256/12.5, 13, 19

(56) References Cited

FOREIGN PATENT DOCUMENTS

| | | | | |
|---|---|---|---|---|
| CH | 603911 A5 * | 8/1978 | ..... | E01F/7/04 |
| CH | 656659 A5 * | 7/1986 | ..... | E01F/7/04 |
| CH | 672934 A5 * | 1/1990 | ..... | E01F/7/04 |
| EP | 0390965 | 10/1990 | | |
| EP | 484563 A1 * | 5/1992 | ..... | E01F/7/04 |
| FR | 1190613 | 10/1959 | | |
| FR | 2622611 | 5/1989 | | |
| JP | 05287711 A * | 11/1993 | ..... | E01F/7/04 |
| JP | 06264416 A * | 9/1994 | ..... | E01F/7/04 |
| JP | 06264417 A * | 9/1994 | ..... | E01F/7/04 |
| JP | 06264418 A * | 9/1994 | ..... | E01F/7/04 |
| WO | 8700878 | 12/1987 | | |
| WO | 9516842 | 6/1995 | | |

* cited by examiner

*Primary Examiner*—Heather Shackelford
*Assistant Examiner*—Lisa M. Saldano
(74) *Attorney, Agent, or Firm*—VanOphem & VanOphem, P.C.

(57) ABSTRACT

The invention concerns a protective barrier installed across a slope. The invention is characterized in that the net is maintained by several supports each having a first mast pointing downstream and whereof one end is fixed to an anchoring point in the ground and a second mast bearing on the ground, the two masts mounted side by side in a crossover geometrical relationship defining a predetermined angle which is determined by the type of use of the protective barrier, i.e. for falling rocks or to protect against avalanches; with the free ends of the masts having stays installed between the masts.

30 Claims, 3 Drawing Sheets

PROTECTIVE BARRIER, IN PARTICULAR FOR MOUNTAINOUS PLACES

CROSS-REFERENCES TO RELATED APPLICATIONS

This application claims the benefit of French Patent Application No. 0014415, filed Nov. 9, 2000, and is a continuation-in-part of International Application No. PCT/FR01/03464, filed Nov. 8, 2001.

FEDERALLY SPONSORED RESEARCH OR DEVELOPMENT

Not applicable.

REFERENCE TO A MICROFICHE APPENDIX

Not applicable.

BACKGROUND OF THE INVENTION

The invention relates to a protective barrier of the kind having a net installed across a slope to protect property and persons from falling rocks and avalanches.

The invention relates more particularly to the structure of the supports that hold the net in position across the slope.

In the mountains, the two major hazards are rock falls and avalanches. Some places at risk can be equipped with structures including very strong metal nets installed across the slope and held in position by a plurality of supports anchored to the ground. The imperatives are different according to the nature of the hazard: rock falls or avalanches.

Barriers protecting against rock falls are designed to intercept falling rocks and to dissipate their kinetic energy. This is achieved by deformation of the net, which usually has expandable meshes. The net is held in position by a plurality of supports spaced along a contour line of the slope. These structures are subjected to concentrated and dynamic loads. Barriers protecting against rock falls are covered by French standard NF P 95-308 which defines the specifications of the structures and classifies their performance.

The nets are conventionally supported by posts positioned normal to the slope and stayed in the uphill, downhill and lateral directions. The conventional system has the drawback that the supports are extremely vulnerable. Moreover, it is necessary to provide the same number of ground anchor points as there are stays. This makes installation on site costly.

Published French patent No. 2 622 611 describes a structure in which the supports are downhill of the net and consequently protected from impact by the net itself. The number of ground anchor points is nevertheless large.

French patent No. 2 712 334 describes a support having a post connected to a wide base (generally a tripod) to the periphery of which the bottom ends of the stays are fixed. This reduces the number of anchorages to one per support, but this system requires a heavy base of high inertia that can resist bending stresses.

On the other hand, barriers protecting against avalanches must be designed not to stop an avalanche but to oppose movements of the mantle of snow that lead to avalanches.

In other words, the net must oppose the thrust of the snow; it is subjected to a uniform and static load. In this type of structure, the net is inclined in the downslope or downhill direction, for example at 30° to the normal to the slope. The supports are spaced along a contour line. There is a post every five meters, for example. Barriers protecting against avalanches are covered by French standard NF P 95-304 which defines the dimensional requirements and the strength of various types of structure.

Avalanche nets are conventionally supported by stayed posts that are inclined in the upslope or uphill direction to the normal to the ground. Adapting the structure described in patent No. 2 712 334 to provide protection against avalanches by modifying the inclination of the posts to the normal to the slope and modifying the base to provide a bipod structure have also been envisaged.

Improvement and enlargement of winter sports resorts are leading to the provision of protection against rock falls and snowslides on slopes very close to heavily populated places. There is therefore a need for structures that are more discreet and that integrate more readily into an urban mountain landscape. The proliferation of places to be protected is also leading to the design of structures that are less costly to fabricate and easier to install. From the esthetic point of view, bulky steel structures are less and less tolerable for this kind of application.

Finally, it is desirable for the same structural members to be usable to build either a barrier to protect against rock falls or an avalanche barrier and for the materials used to harmonize as much as possible with the environment.

BRIEF SUMMARY OF THE INVENTION

The invention provides a satisfactory response to all of these requirements.

The invention proposes a protective barrier that is relatively inexpensive to fabricate and to install, in particular because each support has only one anchor point, and that is relatively compact.

Another object of the invention is to propose a support structure whose geometry can be adapted to either of the required forms of protection (stopping rock falls or stabilizing the mantle of snow), the required configuration being obtained in particular by adjusting the stays.

Another object of the invention is to propose a structure that is particularly discreet, in particular with regard to the net supports, using as much as possible materials integrating well into the landscape, especially wood.

The invention provides a protective barrier of the kind having a net installed across a slope. The net being held by supports anchored to the ground. The barrier is characterized in that a support includes a first mast pointing generally downhill and one end of which is fixed to a ground anchoring means and an upright second mast. One end of which is fixed to ground bearing means separate from and downhill of the ground anchor means, in that the net extends between the ground anchor means and the top end of the second mast. The two masts cross over side-by-side in a chosen geometrical configuration defined at least by the distance between the ground anchor means and the ground bearing means, by the net itself, and by stays installed between the masts.

The ground anchor means and the ground bearing means are separate and the ground anchor means are on the uphill side of the ground bearing means.

In a preferred embodiment, one of the masts includes two spaced parallel posts and the other mast is engaged between the two posts. The mast that consists of two parallel posts is preferably the second mast.

It is noteworthy that all the stays are installed between the masts of the support, at least one of them being of adjustable length so that the geometrical configuration of the support can be adjusted, and in particular adapted to suit the required type of protection. Thus there can be a bottom stay between the ground anchor means and the ground bearing means, a top stay between the free end of the first mast and the top end of the second mast, a downhill stay between the ground bearing means and the free end of the first mast, and an uphill stay between the ground anchor means and the top end of the second mast.

The geometrical configuration of the support is adjusted by more particularly adjusting the length of the downhill stay, which can be fitted with a turnbuckle.

The first and second masts advantageously consist of wooden posts, for better integration into the environment.

BRIEF DESCRIPTION OF THE SEVERAL VIEWS OF THE DRAWINGS

The invention will be more clearly understood and other advantages of the invention will become more clearly apparent in light of the following description of one embodiment of a protective barrier according to the invention, which description is given by way of example only and with reference to the accompanying drawings.

DETAILED DESCRIPTION OF THE PREFERRED EMBODIMENT OF THE INVENTION

Figure 1:
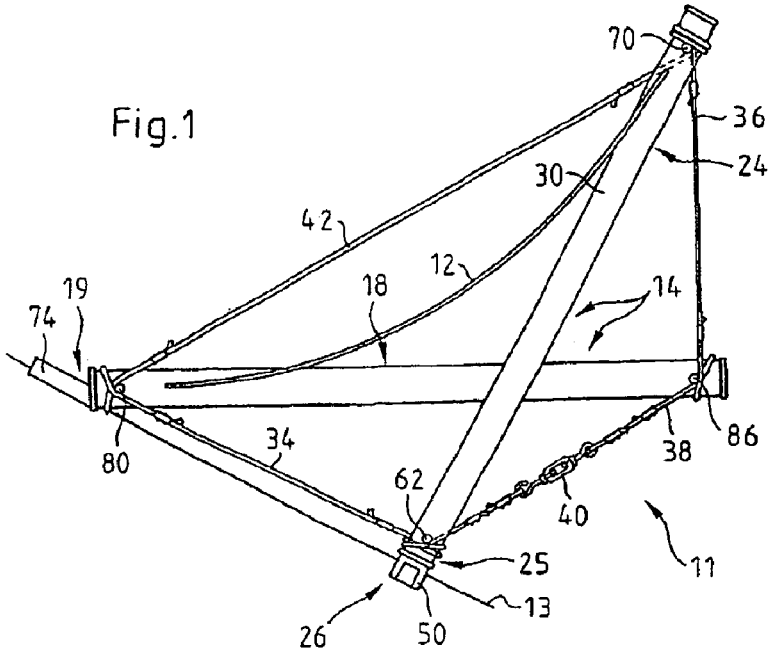
FIG. 1 is a side view of a protective barrier according to the invention.

A protective barrier 11 according to the invention includes a net 12 installed across a slope 13 and held by spaced supports 14, preferably installed along a contour line of the slope 13.

In the drawings, the net 12 is shown in section in the vicinity of one of the supports 14 and is therefore shown only as a line. It is made up of separate and interleaved closed loop metal meshes, of a type known in the art, which gives it a high capacity for elongation by sliding of the meshes one over the other and deformation thereof. This structure is particularly appropriate for absorbing the kinetic energy of rocks (FIG. 3) rolling down the slope. The structure of the net 12 can be different if the protective barrier 11 is adapted to stabilize the mantle of snow and prevent avalanches (FIG. 4). The points at which the net 12 is attached to the supports 14 are not shown in the drawings.

The invention relates more particularly to the structure of each support 14, shown in detail in the drawings.

This kind of support includes a first mast 18, pointing in a generally downhill direction, with an inclination that depends on the site and the type of hazard. One end 19 of the first mast is fixed to ground anchor means 20. If the terrain consists of solid rock, this fixing is obtained by drilling a hole in the rock and setting a stake 21 therein. If the ground is less stable, the "exploded stake" technique described in patent No. 2 712 334 is preferably used. This technique consists of detonating an explosive cartridge at the bottom of the drill hole to obtain a chamber which is filled with concrete in which the anchor stake is set.

The support further includes an upright second mast 24, one end 25 of which is fixed to ground bearing means 26 farther down the slope than the ground anchor means 20. Here the net 12 is attached between the ground anchor means 20 (or a point in the vicinity thereof) and the top end 28 of the second mast. The net 12 can be attached to other points of the support, however, depending on the required configuration.

According to one important feature of the invention, the aforementioned two masts 18, 24 cross over side-by-side in a geometrical configuration chosen to be suited to the nature of the hazard (falling rocks or unstable snow mantle).

Figure 3:
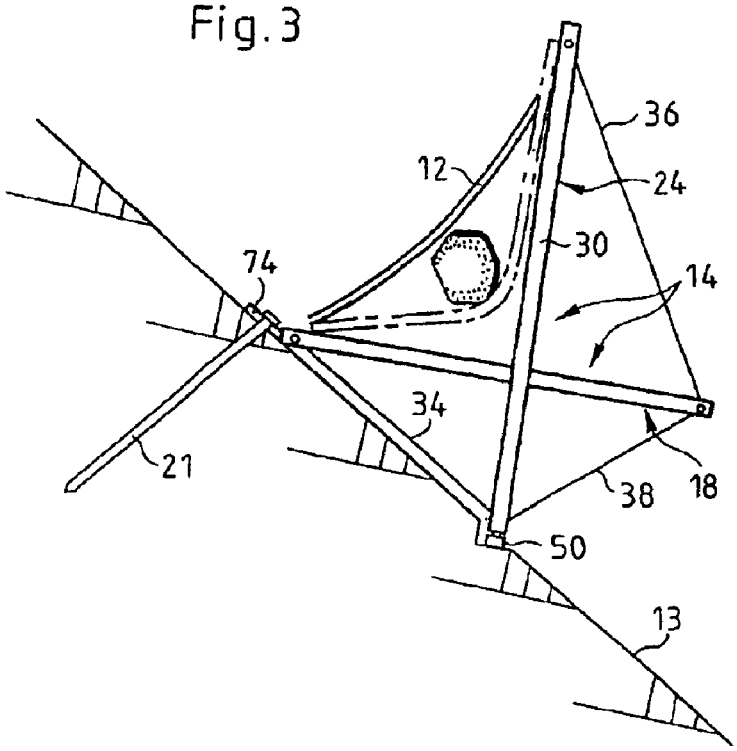
FIG. 3 is a diagram showing a geometrical configuration of the support providing an effective barrier against rock falls.
Figure 4:
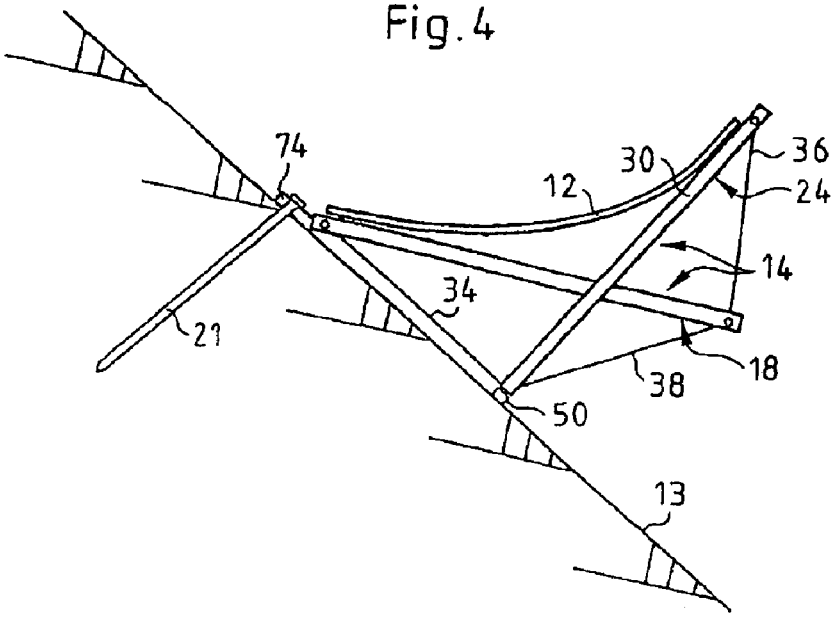
FIG. 4 is a diagram showing a geometrical configuration of the support providing an effective barrier against avalanches.

To be more precise, in the case of intercepting falling rocks, the support has the geometrical configuration shown in FIG. 3 in which the second mast 24 is close to the vertical, whereas to obtain a protective barrier for preventing avalanches, the second mast 24 is instead perpendicular to the slope 13, as shown in FIG. 4.

The required geometrical configuration is defined by a plurality of parameters such as the distance between the ground anchor means 20 and the ground bearing means 26, the width of the net 12 itself, and the length of the stays installed between the two masts.

According to another feature of the invention, one of the masts consists of two spaced parallel posts 30 and the other mast is engaged between the two posts.

In this example, and as in a preferred configuration, the mast that includes two parallel posts 30 is the second mast 24. Note that because all of the stays are installed between the masts, each support requires only one anchor point for its erection.

For example, there is a bottom stay 34 between the ground anchor means 20 and the ground bearing means 26. The length of this stay 34 therefore determines the distance between the ground anchor means 20 and the ground bearing means 26. The support also includes a top stay 36 between the free end of said first mast 18 and the top end 28 of the second mast 24. The support further includes a downhill stay 38 between the bearing means and the free end of the first mast 18. Note that this downhill stay is preferably equipped with a turnbuckle 40 constituting effective means of adjusting the geometrical configuration of the support on site and thereby optimizing the position of the net.

The support can also include an uphill stay 42 between the ground anchor means 20 and the top end 28 of the second mast. This uphill 42 stay can be locally weakened or locally reduced in size to constitute a kind of "fuse" adapted to break on intercepting a rock.

As a general rule, the relative positions of the two masts 18, 24 depend on the elements indicated hereinabove, i.e. essentially the stays 34, 36, 38, and 42 and the net 12 itself. Nevertheless, in some cases, articulating the masts to each other at their crossover point may be envisaged.

Figure 5:
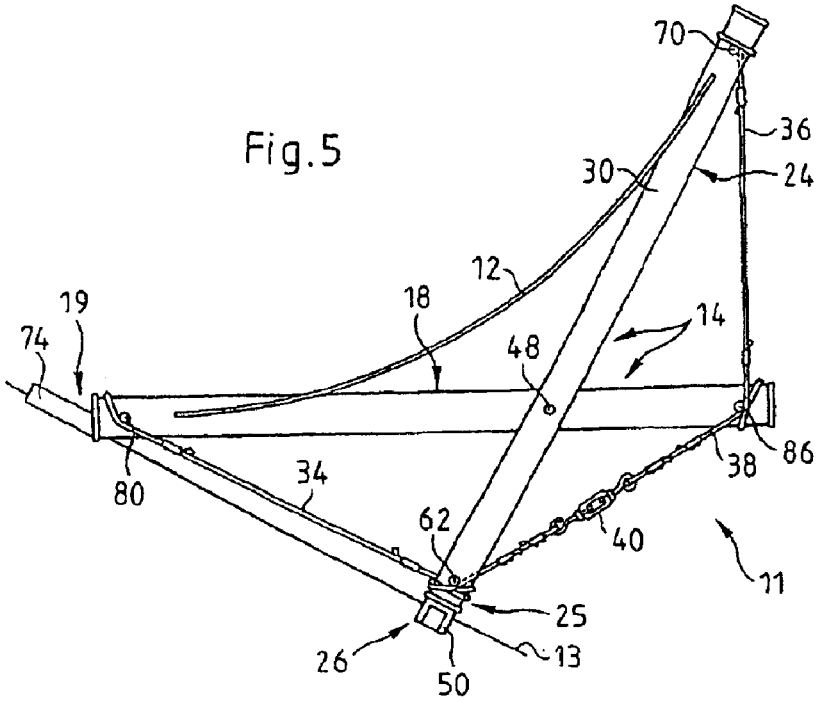
FIG. 5 is a view analogous to FIG. 1 of a different embodiment.

FIG. 5 shows this embodiment, in which an articulation shaft 48 passes through both posts 30 of the second mast 24 and the first mast 18 at a predetermined crossover point. In this case, the uphill stay 42 can be dispensed with.

Figure 2:
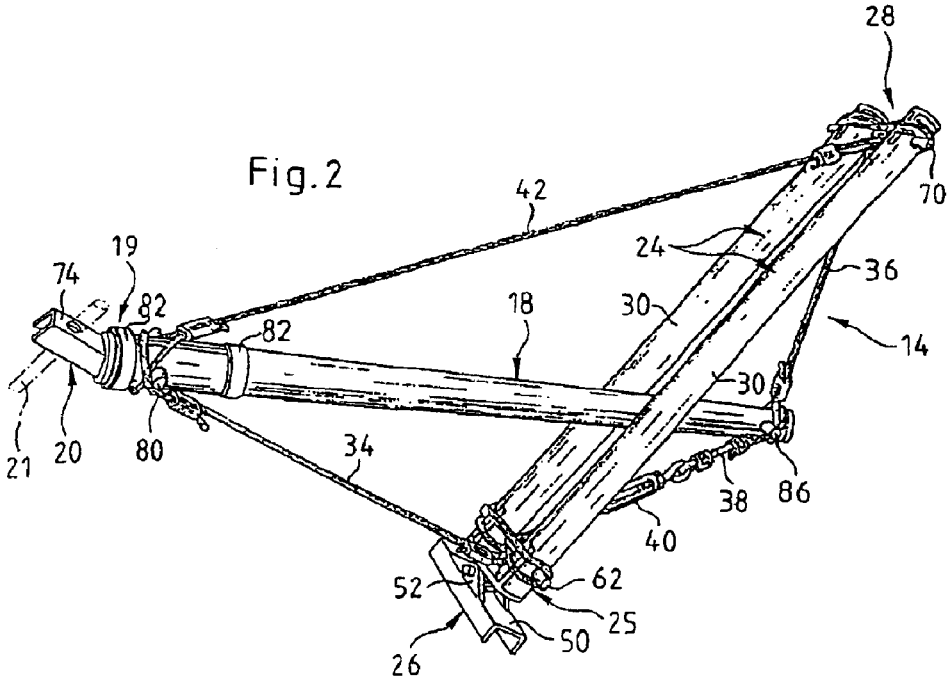
FIG. 2 is a perspective view of one support of said barrier.
Figure 6:
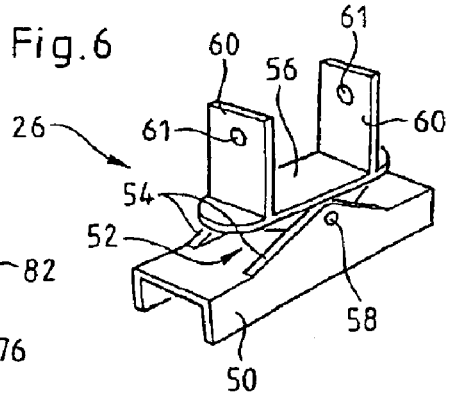

The ground bearing means 26 through which the second mast 24 rests on the ground are described in more detail next with reference to FIGS. 2 and 6. The ground bearing means 26 include a base 50 consisting simply of a length of U-section laid on the ground, the two parallel branches of the section resting on the ground. Articulation means 52 are formed on the plane top face of the base and carry the bottom end 25 of the second mast. To this end, the articulation means 52 include a yoke 54 attached to the base 50, a baseplate 56 fixed to the bottom end of the second mast 24 (the baseplate 56 itself carries a yoke 54 on its bottom face), and a shaft 58 providing the articulation means 52 between the baseplate 56 and the yoke 54. The axis of the shaft 58 is substantially parallel to the slope. The ends of the two posts 30 are fixed to the baseplate 56, on either side of the shaft 58.

In the example shown, the second mast 24 includes two wooden posts 30. The two posts 30 are fixed to the baseplate 56 in the following manner. The baseplate 56 carries two parallel plates 60 engaged in respective central longitudinal slots in the posts.

Figure 7:
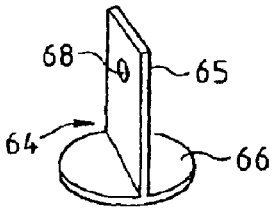
FIGS. 6 to 8 show some of the support members.

Each plate 60 has a hole 61 through it and a transverse rod 62 passes through each post and the corresponding hole 61. This also defines the distance between the two posts. The top free ends of the two posts 30 are fitted with reinforcements 64. The posts have central longitudinal slots and each of them receives a plate 65 attached to an end disk 66. The plate 65 and the disks that constitute the reinforcement are welded perpendicularly to each other (see FIG. 7). Each plate 65 has a hole 68 through it and a transverse rod 70 passes through each post and the corresponding hole. This also contributes to stabilizing the distance between the posts 30 of the second mast 24.

Figure 8:
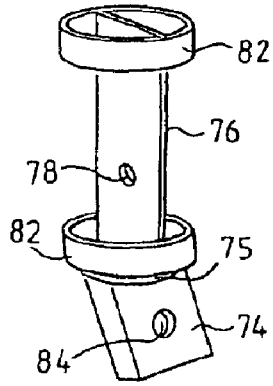

The ground anchor means 20 by means of which one end 19 of the first mast 18 is fixed to the ground are described next with reference to FIGS. 2 and 8. The ground anchor means 20 include a base 74 adapted to be fixed to the ground and to which is assembled a disk-shaped baseplate 75 fixed to the uphill end 19 of the first mast 18.

In the example described, in which the first mast 18 is made of wood, the baseplate 56 of the fixing base is extended by a plate 76 extending along a diameter of the disk and perpendicular thereto, and this plate 76 is engaged in a central longitudinal slot at the uphill end 19 of the first mast 18. There is a hole 78 through the plate 76 and a transverse rod 80 passes through the first mast 18 and the hole 78. Two annular reinforcements 82 are provided at the two ends of the plate. Each reinforcement surrounds the mast when the plate is engaged in the central longitudinal slot thereof. The fixing base 74 and the disk-shpaed baseplate 75 are welded together with an angle between them that depends on the required configuration of the support. The fixing base 74 consists of a length of U-section with a hole 84 through which the anchor stake 21 passes.

The free end of the first mast 18 is also provided with a reinforcement 64 and a transverse rod 86 similar to those at the ends of the two posts 30 of the first mast 18.

As previously indicated, the masts are essentially made of wood, for better integration into the environment. The same structure can nevertheless be imagined with metal tubes, or even girders.

Note further that the ends of the stays terminate in slings passing around the corresponding ends of the masts to which they are attached, the rods 62, 70, 80 and 86 serving as stops. This aligns the forces in the stays with the axial direction relative to the posts constituting the masts.

It is noteworthy that, in the structure described above, all components operating in bending have been eliminated. Moreover, the single anchor point of the support operates in "pull-out" mode, which is the strongest anchoring mode.

The ease and accuracy with which the rest position of the net can be adjusted is an important advantage of the structure of the support described above. In particular, note that the angle between the net and a mast in the vicinity of its point of attachment to the latter is large, to define the optimum tension in the net at rest. This angle can easily be adjusted by adjusting the geometry of the support, primarily by adjusting the turnbuckle 40.

The posts constituting the two masts are preferably machined round timber stock, i.e. have a specific diameter, treated with fungicides and insecticides, for example by impregnating them under pressure with copper salts.

For avalanche prevention at least, a particularly advantageous configuration is one in which the length of the bottom stay is equal to half the length of the uphill stay and the masts are the same length. In this case, the downhill stay and the top stay are the same length as the bottom stay, which simplifies fabrication.

The above geometrical characteristics also optimize the distribution of forces in the various parts of the structure and enable standardization of the posts and stays.

It will be apparent to those skilled in the art that numerous alterations and modifications may be made to the present invention as described without departing from the scope of the invention which is to be limited solely by the appended claims.

What is claimed is:

1. A protective barrier adapted to provide at least one support anchored to a sloped ground with a net attached to said at least one support, said protective barrier comprising:

at least one support having:

a first mast having one end securely fixed to the ground and an opposite end pointing in a downslope direction;

means for anchoring said one end of said first mast to said ground, said anchoring means comprising at least a ground anchoring member;

a second mast having one end bearing on the ground at a predetermined distance downslope from said one end of said first mast; and an opposite end oriented in a direction away from said sloped ground, said second mast being oriented side-by-side to said first mast such that in said side-by-side orientation said first mast and said second mast crossover each other at a predetermined angle to define criss-cross geometrical configuration, said crossover relationship of said second mast to said first mast occurring between said one end and said opposite end of said first mast thereby allowing said opposite end of said first mast and said opposite end of said second mast to be in a free unrestricted state; and means for attaching said one end for said second mast to said ground, said attaching means comprising at least a ground bearing member;

a net having one end attached to said one end of said first mast and an opposite end attached to said second end of said second mast; and means for selecting and maintaining said predetermined angle established by said crossover relationship between said first mast and said second mast, said selecting and maintaining means being located at least between said one end of said first and one end of said second masts as well as between said opposite end of said first mast and said opposite end of said second mast, both said opposite ends being in said free unrestricted state.

2. The protective barrier as claimed in claim 1, wherein said means for selecting and maintaining said predetermined angle established by said crossover relationship further comprises a plurality of stays, each stay of said plurality of stays having one end attached to one of said first mast and said second mast and an opposite end attached to the other of said first mast and said second mast.

3. The protective barrier as claimed in claim 1, wherein one of said first mast and said second mast comprises two spaced parallel posts and wherein the other one of said first mast and said second mast is engaged between said two posts to establish said crossover relationship at said predetermined angle.

4. The protective barrier as claimed in claim 3, wherein said one of said mast which comprises two posts is said second mast.

5. The protective barrier as claimed in claim 1, wherein said first mast and said second mast are made of wood.

6. The protective barrier as claimed in claim 1, wherein said first mast and said second mast are connected at said crossover point by an articulation shaft.

7. The protective barrier as claimed in claim 3, wherein said masts are made of wood.

8. The protective barrier as claimed in claim 3, wherein said first mast and said second mast are connected at said crossover point by an articulation shaft.

9. The protective barrier as claimed in claim 8, wherein said first and said second mast are made of wood.

10. The protective barrier as claimed in claim 2, wherein a first stay of said plurality of stays comprises a bottom stay located between said one end of said first mast and said one end of said second mast.

11. The protective barrier as claimed in claim 2, wherein a second stay of said plurality of stays comprises a top stay attached between said opposite end of said first mast and said opposite end of said second mast.

12. The protective barrier as claimed in claim 2, wherein a third stay of said plurality of stays comprises a downslope stay between said one end of said second mast and said opposite end of said first mast.

13. The protective barrier as claimed in claim 12, wherein said third stay further comprises a turnbuckle.

14. The protective barrier as claimed in claim 12, wherein a fourth stay of said plurality of stays comprises an upslope stay between said one end of said first mast and said opposite end of said second mast.

15. The protective barrier as claimed in claim 2, wherein at least one of said stays of said plurality of stays has an adjustable length whereby said geometrical configuration is adjustable.

16. The protective barrier as claimed in claim 2 wherein said plurality of stays further comprises:

a first bottom stay having one end attached to said one end of said first mast and an opposite end attached to said one end of said second mast;

a second top stay having one end attached to said opposite end of said first mast and an opposite end attached to said opposite end of said second mast;

a third downslope stay having one end attached to said one end of said second mast and an opposite end attached to said opposite end of said first mast; and a fourth upslope stay having one end attached to said one end of said first mast and an opposite end attached to said opposite end of said second mast.

17. The protective barrier as claimed in claim 16, wherein one of said stays includes a turnbuckle.

18. The protective barrier as claimed in claim 17, wherein said turnbuckle is provided in said downslope stay.

19. The protective barrier as claimed in claim 1, wherein said first mast is articulated on said ground anchoring member and said second mast is articulated on said ground bearing member.

20. The protective barrier as claimed in claim 1, wherein said ground bearing member comprises a base; and articulation means attached to said one end of said second mast.

21. The protective barrier as claimed in claim 20, wherein said articulation means comprises a yoke member attached to said base, said yoke member having a pivot axis therein; said protective barrier further comprising a baseplate fixed to the one end of said second mast, said baseplate having a pivot axis therein aligned with said pivot axis of said yoke; and a shaft mounted about said pivot axis of said yoke member and said baseplate whereby said yoke member and said baseplate are pivotable with respect to each other, the axis of said shaft being substantially parallel to said slope.

22. The protective barrier as claimed in claim 21, wherein said second mast further comprises two spaced parallel posts and wherein said first mast is engaged between said two spaced parallel posts, and further wherein the bottom ends of said two parallel posts are mounted on said baseplate on opposite sides of said shaft.

23. The protective barrier as claimed in claim 21, wherein said second mast further comprises two wooden posts, each of said two wooden posts having a central slot located at respective ends thereof; and a transverse hole in each end of said wooded posts having said central slot; and further wherein said baseplate further comprises two parallel plates, each plate having a hole therein, each of said two parallel plates mounted in said central slot located at respective ends of each of said two wooden posts, said transverse holes in said posts aligning with said holes in each of said two parallel plates, said protective barrier further comprising a transverse rod mounted in said holes of said wooden posts and said two parallel plates to secure each of said two wooden posts to said baseplate.

24. The protective barrier as claimed in claim 1, wherein said ground anchoring member comprises a ground fixing base and a baseplate having one end connected to said ground fixing base and an opposite end connected to said one end of said first mast.

25. The protective barrier as claimed in claim 13, wherein said first mast is made of wood and said baseplate of said ground fixing base further comprises an extended transverse plate extending in said central slot of said first mast, said extended transverse plate having a hole therethrough; and a transverse rod mounted in said hole of said mast and said extended transverse plate.

26. The protective barrier as claimed in claim 25, wherein the end of said extended transverse plate opposite said baseplate has an annular reinforcement mounted to said mast.

27. The protective barrier as claimed in claim 2, wherein the ends of each of said plurality of stays are formed as slings such that each sling passed around corresponding ends of said mast to which they are attached.

28. The protective barrier as claimed in claim 16, wherein said first mast and second mast are substantially the same length and the length of said first bottom stay is equal to half the length of said fourth upslope stay.

29. A protective barrier as claimed in claim 1, further comprising a plurality of supports anchored to the ground with a net attached to each of said plurality of supports.

30. A protective barrier adapted to provide a plurality of supports anchored to a sloped ground with a net attached to each of said support, said protective barrier comprising:

each of said support having:

a first mast having one end securely fixed to the ground and an opposite end pointing in a downslope direction;

means for anchoring said one end of said first mast to said ground, said anchoring means comprising at least a ground anchoring member;

a second mast having one end bearing on the ground at a predetermined distance downslope from said one end of said first mast; and an opposite end oriented in a direction away from said sloped ground, said second mast being oriented side-by-side to said first mast such that in said side-by-side orientation said first mast and said second mast crossover each other at a predetermined angle to define criss-cross geometrical configuration, said crossover relationship of said second mast to said first mast occurring between said one end and said opposite end of said first mast thereby allowing said opposite end of said first mast and said opposite end of said second mast to be in a free unrestricted state; and means for attaching said one end for said second mast to said ground, said attaching means comprising at least a ground bearing member;

a net having one end attached to said one end of said first mast and an opposite end attached to said second end of said second mast; and means for selecting and maintaining said predetermined angle established by said crossover relationship between said first mast and said second mast, said selecting and maintaining means being located at least between said one end of said first and one end of said second masts as well as between said opposite end of said first mast and said opposite end of said second mast, both said opposite ends being in said free unrestricted state.

* * * * *

UNITED STATES PATENT AND TRADEMARK OFFICE

CERTIFICATE OF CORRECTION

PATENT NO. : 6,926,471 B2
DATED : August 9, 2005
INVENTOR(S) : Pascal Rambaud

It is certified that error appears in the above-identified patent and that said Letters Patent is hereby corrected as shown below:

Title page,
Item [62], Related U.S. Application Data, delete -- Continuation-in-part of --.

Column 1,
Lines 7-8, delete "is a continuation-in-part".

Column 7,
Line 39, delete "12" and insert -- 2 --.

Signed and Sealed this

Twenty-first Day of February, 2006

JON W. DUDAS
*Director of the United States Patent and Trademark Office*